US005203384A

United States Patent [19]

Hansen

[11] Patent Number: 5,203,384

[45] Date of Patent: Apr. 20, 1993

[54] COMBINATION CASTING FOR A BLENDING DISPENSER

[75] Inventor: Robert E. Hansen, Salisbury, Md.

[73] Assignee: Dresser Industries, Inc., Dallas, Tex.

[21] Appl. No.: 892,625

[22] Filed: Jun. 1, 1992

Related U.S. Application Data

[63] Continuation of Ser. No. 659,196, Feb. 21, 1991, abandoned, which is a continuation-in-part of Ser. No. 568,431, Aug. 15, 1990, abandoned.

[51] Int. Cl.[5] ..... B67D 5/56

[52] U.S. Cl. ..... 141/59; 141/45; 141/105; 141/285; 285/132; 285/133.1; 285/150; 220/746; 220/86.2

[58] Field of Search ..... 141/5, 44, 45, 54, 56, 141/59, 100, 102, 104–107, 234, 236, 247, 285, 290, 302, 304, 382, 383, 386, 387, 392; 285/132, 133.1, 150; 220/86.2, 745, 746, 759, 750

[56] References Cited

U.S. PATENT DOCUMENTS

| | | | |
|---|---|---|---|
| 910,885 | 1/1909 | Waitz | 285/150 X |
| 2,971,532 | 2/1961 | McLaren et al. | 285/150 X |
| 3,424,348 | 1/1969 | Nelson | 222/134 |
| 3,590,890 | 7/1971 | Young | 141/382 X |
| 3,630,547 | 12/1971 | Hartshorn, Jr. | 285/150 |
| 3,826,291 | 7/1974 | Steffens | 141/290 X |
| 3,838,797 | 10/1974 | Nelson | 222/134 |
| 3,980,112 | 9/1976 | Basham | 141/392 |
| 4,049,159 | 9/1977 | Todd et al. | 222/144.5 |
| 4,062,384 | 12/1977 | Frahm et al. | 141/290 X |
| 4,068,687 | 1/1978 | Long | 141/59 |
| 4,074,734 | 2/1978 | De Beau et al. | 141/44 |
| 4,090,539 | 5/1978 | Krupp | 141/392 X |
| 4,095,626 | 6/1978 | Healy | 141/206 |
| 4,131,142 | 12/1978 | Barr et al. | 141/302 |
| 4,223,807 | 9/1980 | Caswell et al. | 222/28 |
| 4,252,161 | 2/1981 | Krupp | 141/392 X |
| 4,274,549 | 6/1981 | Germain | 220/85 VR |
| 4,295,505 | 10/1981 | Hassellmann et al. | 141/301 |
| 4,310,033 | 1/1982 | Deters | 141/44 |
| 4,649,970 | 3/1987 | Bower et al. | 141/302 |
| 4,687,033 | 8/1987 | Furrow et al. | 141/59 |
| 4,776,615 | 10/1988 | Young | 285/136 |
| 4,827,987 | 5/1989 | Faeth | 141/59 |
| 4,842,027 | 6/1989 | Faeth | 141/45 |
| 4,951,720 | 8/1990 | Grantham | 141/44 |
| 4,971,118 | 11/1990 | Cluff | 141/105 X |
| 5,054,818 | 10/1991 | Briet | 285/150 X |
| 5,067,533 | 11/1991 | Carder, Sr. et al. | 141/392 |

OTHER PUBLICATIONS

Series 580E, Pushbutton Fixed-Ratio Blending Dispenser, 1989.

*Primary Examiner*—Henry J. Recla
*Assistant Examiner*—Casey Jacyna
*Attorney, Agent, or Firm*—Matthews & Associates

[57] ABSTRACT

The problems associated with combining fuel blending and vapor recovery functions in a fuel dispenser are substantially overcome by a casting and method which provide for not only fuel blending and dispensing, but also vapor recovery. The casting and method of the present invention are adapted for use with a coaxial hose having a small diameter inner hose for dispensing fuel and a larger diameter outer hose defining an annular vapor recovery passage between the inner and outer hoses. The casting of the present invention has first and second product inlets intersecting at a mixing or blending chamber which empties into a single product outlet. As such, blending occurs within the casting and the product output can be either of the first or second products, for example, high or low grade unleaded fuel, or an intermediate grade blended fuel product produced by blending selected volumes of the first and second products. The invention is particularly though not exclusively adapted to use with a dispenser having a single nozzle on at least one side of the dispenser for dispensing high, low, and mid-grade fuels. In accordance with a preferred embodiment of the present invention, one end of the casting incorporates two fuel product inlets and at least one recovered vapor outlet while the opposite end of the casting has a fuel product outlet and an annular vapor recovery inlet.

6 Claims, 3 Drawing Sheets

COMBINATION CASTING FOR A BLENDING DISPENSER

CROSS-REFERENCE TO RELATED APPLICATIONS

This is a continuation of copending application Ser. No. 07/659,196, filed on Feb. 21, 1991, now abandoned, which was a continuation in part of then copending application Ser. No. 07/568,431, filed Aug. 15, 1990, now abandoned.

BACKGROUND OF THE INVENTION

This invention relates to blending fuel dispensers having the facility for vapor recovery and, more particularly, it concerns a combination casting providing not only first and second product inlets, a mixing chamber, and a blended product outlet, but also a separate passage arrangement providing an annular vapor recovery inlet and one or more recovered vapor outlets.

Typically, blending dispensers provide one or more intermediate grades of fuel using, for example, a blending valve to regulate the volumetric ratio of a low octane product, such as unleaded regular, and a high octane product, such as unleaded premium, so as to make available at least three grades of fuel while only requiring the use of two supply tanks and pumps. Many such blending dispensers incorporate a twin hose arrangement of either two separate hoses or one coaxial hose having an inner and outer hose connected to a single nozzle with each of the high and low grade products being supplied in one of the hoses and with the actual fuel blending occurring in the nozzle. An example of such a blending dispenser is the Wayne® Pushbutton Fixed-Ratio Blending Dispenser produced by Wayne Division of Dresser Industries, Inc., Salisbury, Md. Additional blending dispensers are described in U.S. Pat. No. 3,424,348, issued to D. W. Nelson on Jan. 28, 1969; U.S. Pat. No. 3,838,797 issued to D. W. Nelson on Oct. 1, 1974; U.S. Pat. No. 4,049,159 issued to J. A. Todd et al on Sep. 20, 1977; and U.S. Pat. No. 4,223,807 issued to R. L. Caswell et al on Sep. 23, 1980.

Conventional fuel dispensers having vapor recovery systems which remove fuel vapors displaced by the dispensed fuel usually have either separate fuel dispensing and vapor recovery hoses or a coaxial hose arrangement with, for example, fuel being dispensed in an inner hose and vapors being recovered in an annular space between the inner house and an outer hose. Examples of vapor recovery systems having separate fuel dispensing and vapor recovery hoses are disclosed in U.S. Pat. No. 4,131,142 issued to R. H. Barr et al on Dec. 26, 1978; U.S. Pat. No. 4,295,505 issued to D. E. M. Hasselmann et al on Oct. 20, 1981; U.S. Pat. No. 4,310,033 issued to E. M. Deters on Jan. 12, 1982; and U.S. Pat. No. 4,776,615 issued to R. K. Young on Oct. 11, 1988. Alternatively, U.S. Pat. No. 4,068,687 issued to R. A. Long on Jan. 17, 1978; U.S. Pat. No. 4,095,626 issued to J. W. Healy on Jun. 20, 1978; U.S. Pat. No. 4,687,033 issued to R. W. Furrow et al on Aug. 18, 1987; U.S. Pat. No. 4,827,987 issued to W. P. Faeth on May 9, 1989; and U.S. Pat. No. 4,842,027 issued to W. P. Faeth on Jun. 27, 1989, disclose vapor recovery systems incorporating a coaxial, twin hose fuel dispensing and vapor recovery arrangement.

Attempts at developing a blending dispenser with the facility for vapor recovery ended in a dispenser having a rather elaborate and unwieldy three hose arrangement of two fuel hoses and a vapor recovery hose joined to a single nozzle.

In light of the above, there is a need for an improved apparatus for dispensing blended fuels while at the same time providing for vapor recovery.

SUMMARY OF THE INVENTION

In accordance with the present invention, the problems associated with combining fuel blending and vapor recovery functions in a fuel dispenser are substantially overcome by a casting and method which provide for not only fuel blending and dispensing, but also vapor recovery. The casting and method of the present invention are adapted for use with a coaxial hose having a small diameter inner hose for dispensing fuel and a larger diameter outer hose defining an annular vapor recovery passage between the inner and outer hoses.

The casting of the present invention has first and second product inlets intersecting at a mixing or blending chamber which empties into a single product outlet. As such, blending occurs within the casting and the product output can be either of the first or second products, for example, high or low grade unleaded fuel, or an intermediate grade blended fuel product produced by blending selected volumes of the first and second products.

The invention is particularly though not exclusively adapted to use with a dispenser having a single nozzle on at least one side of the dispenser for dispensing high, low, and mid-grade fuels. In accordance with a preferred embodiment of the present invention, one end of the casting incorporates two fuel product inlets and one or more recovered vapor outlets while the opposite end of the casting has a fuel product outlet and an annular vapor recovery inlet.

Accordingly, a principal object of the present invention is to provide a single casting which serves as a mixing chamber for a plurality of fuel products and is adapted for connection to a vapor recovery type coaxial hose. Another and more specific object of the invention is the provision of a combination casting and method for dispensing blended fuel products and for recovering fuel vapors displaced during dispensing utilizing a coaxial hose and single nozzle arrangement. Yet another object of the invention is the provision of a blending dispenser having the facility for vapor recovery. Other objects and further scope of applicability of the present invention will become apparent from the detailed description to follow taken in conjunction with the accompanying drawings in which like parts are designated by like reference characters.

DETAILED DESCRIPTION OF TUE PREFERRED EMBODIMENTS

Figure 2:
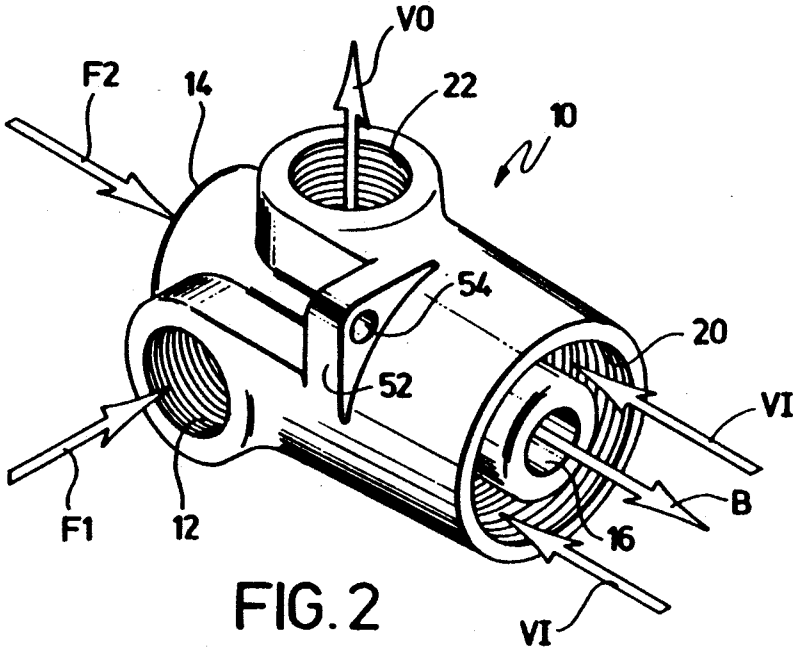
FIG. 2 is a perspective view representing the combination casting of FIG. 1.
Figure 1:
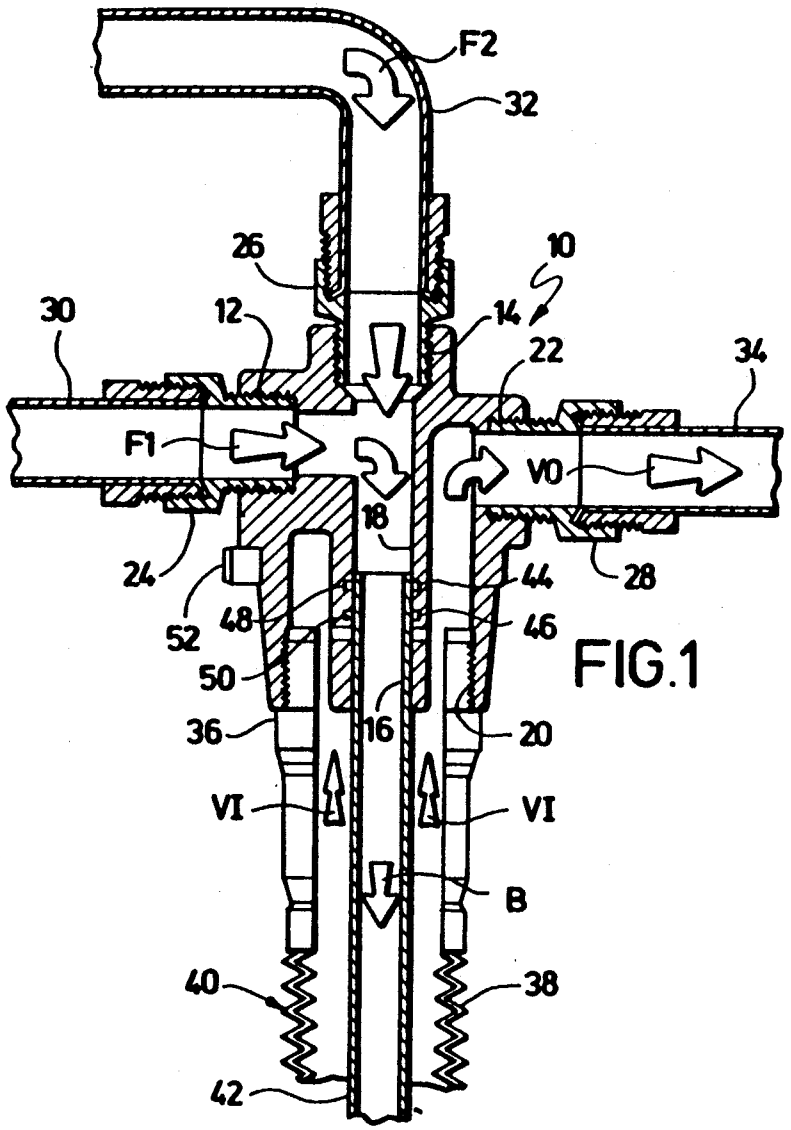
FIG. 1 is a cross section illustration of an exemplary embodiment of the casting, tubing and hose arrangement of the present invention.

In FIGS. 1 and 2 of the drawings, an exemplary casting in accordance with the present invention is generally designated by the reference numeral 10 and shown to include first and second fuel product inlets 12 and 14 and a fuel product outlet 16. The product inlets merge to form a mixing or blending chamber 18 which empties into the mixed or blended product outlet 16. The casting 10 further includes an annular vapor recovery inlet 20 which leads to a recovered vapor outlet 22.

Each of the fuel product inlets 12 and 14 and the vapor outlet 22 have internal helical threads adapted to receive the external helical threads of respective weldless pipe fittings 24, 26 and 28. These fittings secure respective flared-out ends of first and second fuel product tubes or pipes 30 and 32 and a vapor tube or pipe 34 to the casting 10.

As shown in FIG. 1 of the drawings, each of the fittings 24, 26 and 28 are straight fittings, however, it is to be understood that one or more of these may be replaced with elbow fittings. For example, the second product fitting 26 can be instead an elbow fitting so as to reduce the overall height of the casting and tubing assembly to match dispenser dimensions.

The annular vapor recovery inlet 20 has internal helical threads adapted to receive the external helical threads on the upper end of a coaxial hose connector 36. The lower end of the connector 36 is secured to an outer hose 38 of a coaxial hose 40.

The coaxial hose 40 also includes an inner hose 42 the upper end of which is received within the blended product outlet 16. The inner surface of the outlet 16 includes two annular recesses 44 and 46 which receive respective o-rings 48 and 50 so as to provide a fluid tight seal between the outlet 16 and inner hose 42. The inner hose 42 is held in position by a conventional coaxial hose spring clip arrangement (not shown) within the connector 36.

With reference again to FIGS. 1 and 2 of the drawings, the combination casting 10 includes a mounting flange 52 having a cylindrical opening 54 for receiving a bolt for mounting the casting 10 to a dispenser. In accordance with a preferred embodiment, the casting 10 is formed of aluminum.

Figure 3:
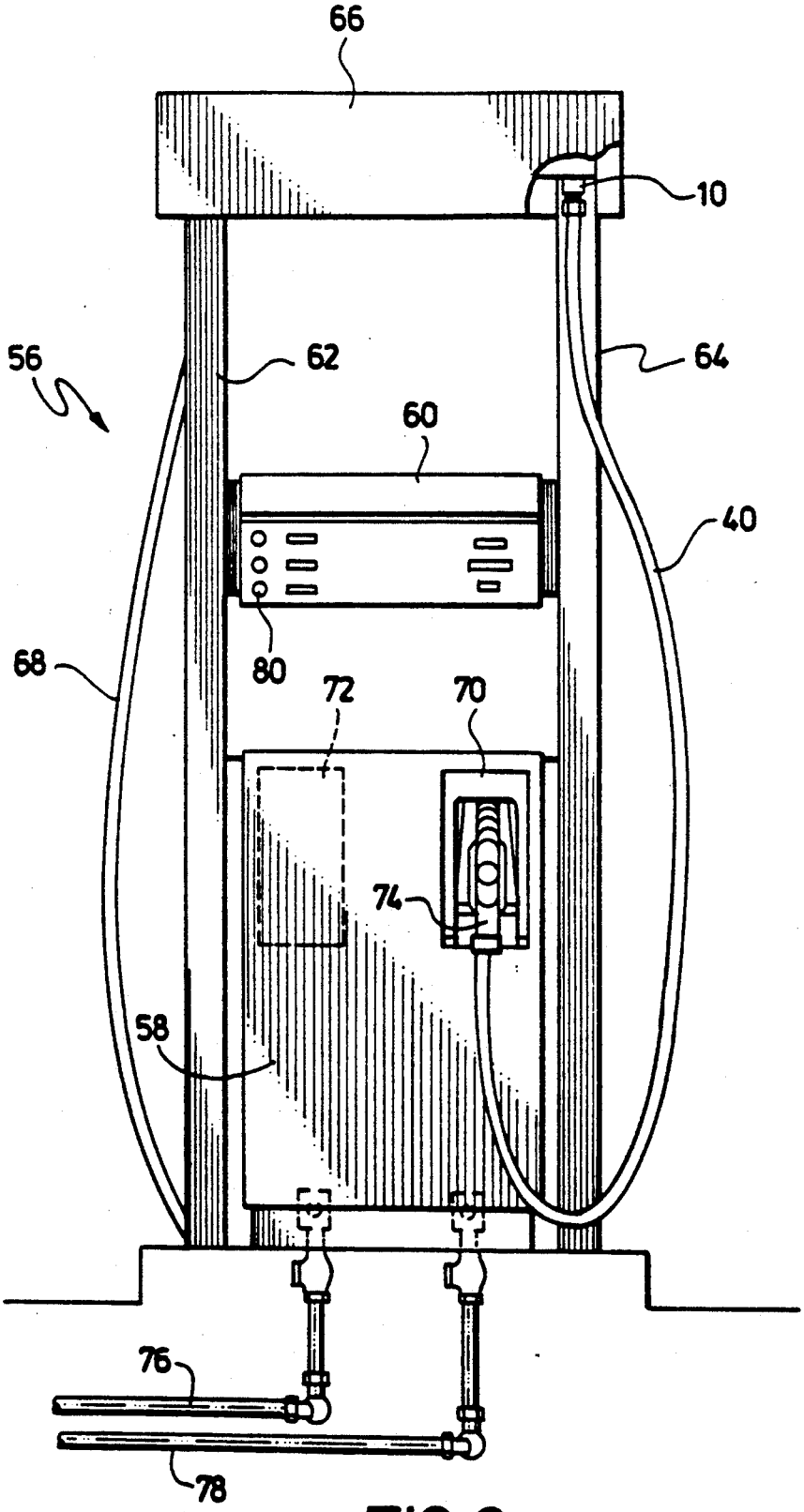
FIG. 3 is a side elevation of a blending dispenser incorporating the casting and hose arrangement of the present invention.

As shown in FIG. 3 of the drawings, the casting 10 and coaxial hose 40 of FIGS. 1 and 2 are incorporated within a three grade, push-button, blending dispenser generally designated 56 and shown to include a lower chassis 58, a raised push-button selector and display module panel 60, side housings 62 and 64, a valance 66, and a second coaxial hose 68 attached at the top end to another casting exactly like the casting 10. The lower chassis 58, houses a pair of meters, a pair of pulsers, a blend valve and a blend valve controller. The chassis 58 also supports nozzle boots or receptacles 70 and 72 which support respective nozzles with only one nozzle 74 being shown for the sake of clarity.

The blending dispenser 56 of the present invention receives low and high grade product from remote pumps along respective supply pipes 76 and 78. Although the dispenser 56 provides three grades of gasoline to the customer, only low and high grade product need be supplied to the dispenser because the mid-grade product is produced by blending the high and low grade products in a ratio set electronically in the blend valve controller.

Operation of the dispenser 56 entails selecting one of the three grades to be dispensed by depressing one of three push-buttons 80, lifting the nozzle 74 from the boot 70, activating the dispenser by raising a lever in the lower portion of the boot, inserting the nozzle in the tank to be filled, and then squeezing the trigger in the nozzle 74. If the customer selects the high octane product and this product corresponds to the first fuel product (F1) in FIGS. 1 and 2, then only this high grade product (F1) will enter the mixing chamber 18 and pass through the outlet port 16 and inner hose 42 as the outlet fuel product (B). Similarly, if the customer chooses the low grade product and this product corresponds to the second fuel product (F2) in FIGS. 1 and 2, then only this low grade product (F2) will enter the mixing chamber 18 and travel through the product outlet 16 as product (B). However, if the customer selects the mid-grade fuel, then both the first and second fuel products (F1 and F2) will enter the mixing chamber 18 and exit along the outlet 16 as the blended fuel product (B).

As fuel is being dispensed, the vapors displaced from the tank are drawn up through the annular space between the inner and outer hoses 42 and 38 of the coaxial hose 40. These fuel vapors (VI) are drawn through the annular vapor inlet 20 and pass through the recovered vapor outlet 22 as recovered vapor (VO). The fuel vapors are caused to be drawn through the hose 40 and casting 10 by, for example, a vapor recovery system vacuum pump connected to the vapor tube 34.

Figure 5:
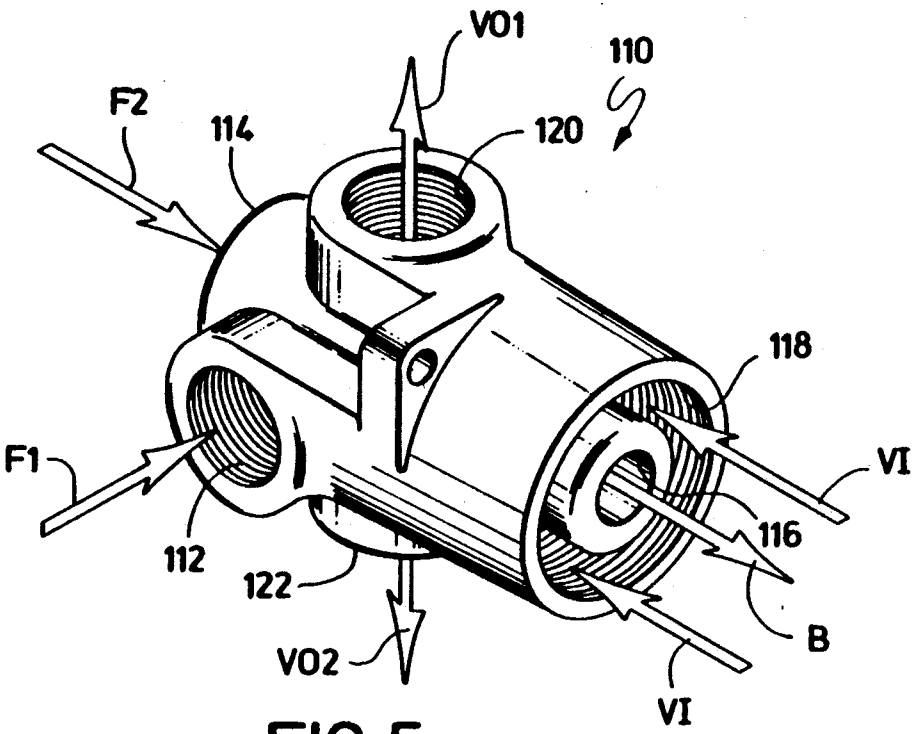
Figure 4:
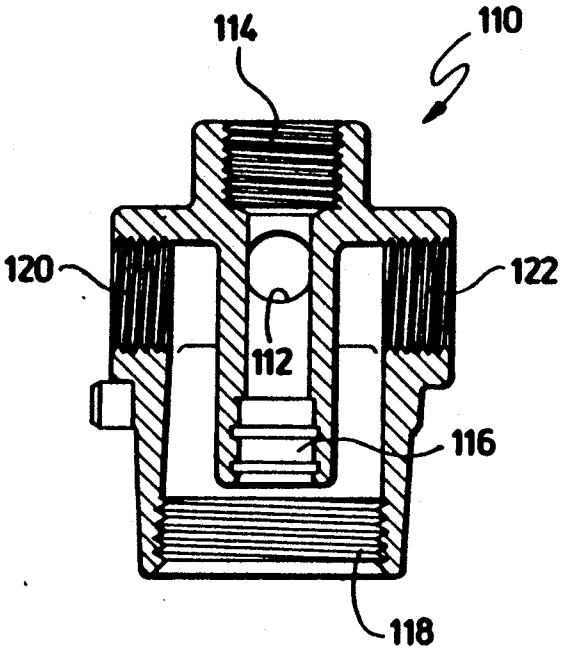
FIG. 4 is a cross section illustration of a combination casting having opposing vapor recovery outlets; and, FIG. 5 is a perspective view of the combination casting embodiment of FIG. 4.

In FIGS. 4 and 5 of the drawings, a second embodiment of a casting in accordance with the present invention is generally designated by the reference numeral 110 and shown to include first and second fuel product inlets 112 and 114 and a fuel product outlet 116. The casting 110 further includes an annular vapor recovery inlet 118 which leads to first and second recovered vapor outlets 120 and 122.

The casting 110 differs from the exemplary casting 10 of FIGS. 1 and 2 in that it includes an additional vapor recovery outlet 122 directly opposite the vapor outlet 120. In all other respects, the casting 110 is constructed in the same fashion as the casting 10 of FIGS. 1 and 2.

With reference to FIG. 5 of the drawings, the casting 110 is adapted to receive fuel vapors (VI) through the annular vapor inlet 118 and allow these vapors to be drawn out as recovered vapor (V01 and V02) through the vapor outlets 120 and 122. Further, the casting 110 is adapted to receive first and second fuel products (F1 and F2) at product inlets 112 and 114 and to provide either of the first and second fuel products (F1 and F2) or a blended fuel product (B) at the fuel outlet 116.

With the vapor recovery outlet 122 plugged with a blind plug (not shown), the casting 110 (FIGS. 4 and 5) would be used in exactly the same fashion as the casting 10 of FIGS. 1 and 2. However, since the casting 110 includes opposing vapor outlets 120 and 122, it enjoys the added benefit of providing for the connection of a vapor recovery tube to either of the outlets while plugging the opposing outlet. This provides for the placement of the casting and location of the vapor tube to accommodate various casting locations and space constraints within the fuel dispenser.

Moreover, either one of the vapor recovery ports 120 and 122 may serve instead as a vapor inlet when the casting 110 is arranged in series with like castings connected to a single vapor recovery system. Consequently, the addition of the second vapor outlet 122 allows the casting 110 to accommodate different locations and space constraints within a dispenser and to provide for a series arrangement of such castings to a common vapor recovery system.

Thus, it will be appreciated that as a result of the present invention, a highly effective combination casting and method is provided by which the principal object and others are completely fulfilled. It is contemplated and will be apparent to those skilled in the art from the foregoing description and accompanying drawing illustrations that variations and/or modifications of the disclosed embodiment may be made without departure from the invention. Accordingly, it is expressly intended that the foregoing description and accompanying drawings are illustrative of a preferred embodiment only, not limiting, and that the true spirit and scope of the present invention be determined by reference to the appended claims.

What is claimed is:

1. A casting member for use with a blending dispenser having vapor recovery, comprising:

at least first and second product inlets, a mixing chamber, a product outlet, an annular vapor recovery inlet, and at least one vapor recovery outlet; wherein said casting member being a single-pieced article that can be formed in a single casting process;

said mixing chamber is formed by the intersection of said first and second product inlets;

said product outlet and said annular vapor recovery inlet are adapted for connection to a coaxial hose;

said annular vapor recovery inlet is an annular opening surrounding said product outlet;

said first and second product inlets and said at least one vapor recovery outlet are substantially at one end of said casting while said product outlet and said annular vapor recovery inlet are at the other end of said casting;

said product outlet includes a pair of spaced o-ring seals;

each of said first and second product inlets and said at least one vapor recovery outlet are threaded so as to receive a threaded tube fitting;

said annular vapor recovery inlet is threaded so as to receive a threaded coaxial hose connector; and said first product inlet and said at least one vapor recovery outlet are oriented perpendicular to said second product inlet, said product outlet, and said annular vapor recovery inlet.

2. The casting of claim 1, further comprising a mounting flange.

3. The casting of claim 2, wherein said casting is formed of aluminum.

4. In a blending dispenser providing at least one midgrade blended product, the improvement comprising a casting having at least first and second product inlets, a mixing chamber, a product outlet, an annular vapor recovery inlet, and at least one vapor recovery outlet; wherein said casting member being a single-pieced article that can be formed in a single casting process, said mixing chamber is formed by the intersection of said first and second product inlets;

said dispenser includes at least one coaxial hose and said product outlet and said annular vapor recovery inlet are adapted for connection to said coaxial hose;

said annular vapor recovery inlet is an annular opening surrounding said product outlet;

said first and second product inlets and said at least one vapor recovery outlet are substantially at one end of said casting while said product outlet and said annular vapor recovery inlet are at the other end of said casting;

said product outlet includes a pair of spaced o-ring seals;

said dispenser includes first and second product tubes and at least one vapor tube and each of said first and second product inlets and said at least one vapor recovery outlet are threaded so as to receive a threaded tube fitting;

said coaxial hose includes a connector at one end and a nozzle at the other and said annular vapor recovery inlet is threaded so as to receive a threaded end of said coaxial hose connector; and said first product inlet and said at least one vapor recovery outlet are oriented perpendicular to said second product inlet, said product outlet, and said annular vapor recovery inlet.

5. The dispenser of claim 4, wherein said casting includes a mounting flange for facilitating the mounting of said casting to said dispenser.

6. The dispenser of claim 5, wherein said casting is formed of aluminum.

* * * * *